US006178881B1

(12) United States Patent
Schwelling

(10) Patent No.: US 6,178,881 B1
(45) Date of Patent: Jan. 30, 2001

(54) DEVICE FOR DRIVING THE PRESS PLATE OF A WASTE BALE PRESS

(76) Inventor: Hermann Schwelling, Hartmannweg 5, D-88682 Salem (DE)

( * ) Notice: Under 35 U.S.C. 154(b), the term of this patent shall be extended for 0 days.

(21) Appl. No.: 09/259,033

(22) Filed: Feb. 26, 1999

(30) Foreign Application Priority Data

Feb. 28, 1998 (DE) ..... 198 08 418

(51) Int. Cl.[7] ..... B30B 9/30; B65B 27/12

(52) U.S. Cl. ..... 100/18; 100/31; 100/48; 100/179; 100/191; 100/269.08

(58) Field of Search ..... 100/17, 18, 31, 100/179, 191, 269.06, 269.08, 269.2, 269.01, 100, 229 A, 48; 414/517, 525.2, 525.6

(56) References Cited

U.S. PATENT DOCUMENTS 3,211,309 * 10/1965 Shubin ..... 414/525.6
3,861,298 * 1/1975 Melos ..... 100/269.01
4,041,856 8/1977 Fox .
4,544,320 * 10/1985 Haines ..... 414/517
4,877,366 * 10/1989 De Filippi ..... 100/296.2
5,064,332 * 11/1991 Edelhoff et al. ..... 414/517
5,178,062 * 1/1993 Spiers ..... 100/269.08
5,203,669 * 4/1993 Klossek et al. ..... 414/525.2

* cited by examiner

*Primary Examiner*—Stephen F. Gerrity
(74) *Attorney, Agent, or Firm*—Friedrich Kueffner

(57) ABSTRACT

A waste bale press of horizontal construction used for manufacturing bound bales of predominantly organic waste materials, such as paper, cardboard, wood boxes or other used packaging materials includes a press shaft with a filling shaft in front of the press shaft and a drive portion arranged in front of the filling shaft. The drive portion includes two hydraulic cylinders which are arranged so as to intersect in the basic position thereof and whose free piston rod ends act on the press plate. The ends of the hydraulic cylinders are connected in an articulated manner on brackets or the like located laterally of the press housing outside of the parallel limiting walls of the press housing in the most rearward part of the drive portion.

10 Claims, 4 Drawing Sheets

DEVICE FOR DRIVING THE PRESS PLATE OF A WASTE BALE PRESS

BACKGROUND OF THE INVENTION

1. Field of the Invention

The present invention relates to a waste bale press of predominantly horizontal construction, i.e., a bale press having a press plate which acts in the horizontal direction. The press is used for manufacturing bound bales of predominantly organic waste materials, such as paper, cardboard, wood boxes or other used packaging materials. The press includes a press shaft with a filling shaft in front of the press shaft and a drive portion arranged in front of the filling shaft. The drive portion includes two hydraulic cylinders which are arranged so as to intersect in the basic position thereof and whose free piston rod ends act on the press plate.

2. Description of the Related Art

For the purpose of reducing the structural length of presses of the above-described type, U.S. Pat. No. 4,041,856 discloses in connection with a vertically acting press to arrange in the drive portion on the side of the head two intersecting hydraulic cylinders which are slightly vertically inclined in the basic position thereof, wherein the free piston rod ends of the hydraulic cylinders are connected in an articulated manner to the press plate.

It is apparent that such a cylinder arrangement is capable of applying only relatively small pressing forces onto the material to be compacted; this is because, as a result of the shallow cylinder arrangement, the force components acting on the side walls of the press shaft are over the greatest portion of the pressing stroke greater than the actual pressing forces acting in the vertical direction.

SUMMARY OF THE INVENTION

Therefore, it is the primary object of the present invention, utilizing the known teaching in connection predominantly with bale presses having a horizontal movement of the press plate, to provide a cylinder arrangement in which the force components directed against the side walls of the press shaft are kept as small as possible and, thus, the actual pressing force is available to a high extent already in the initial stage of the pressing procedure.

In accordance with the present invention, the ends of the hydraulic cylinders are connected in an articulated manner on brackets or the like located laterally of the press housing outside of the parallel limiting walls of the press housing in the most rearward part of the drive portion.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
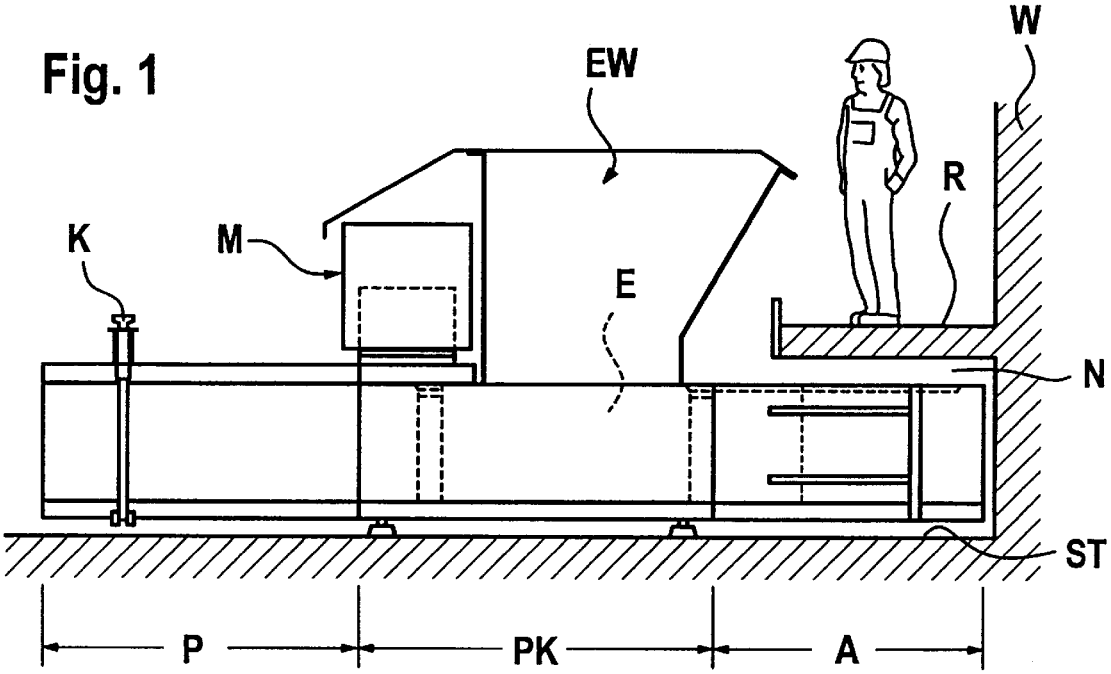
FIG. 1 is a side view of a horizontally acting bale press.
Figure 4:
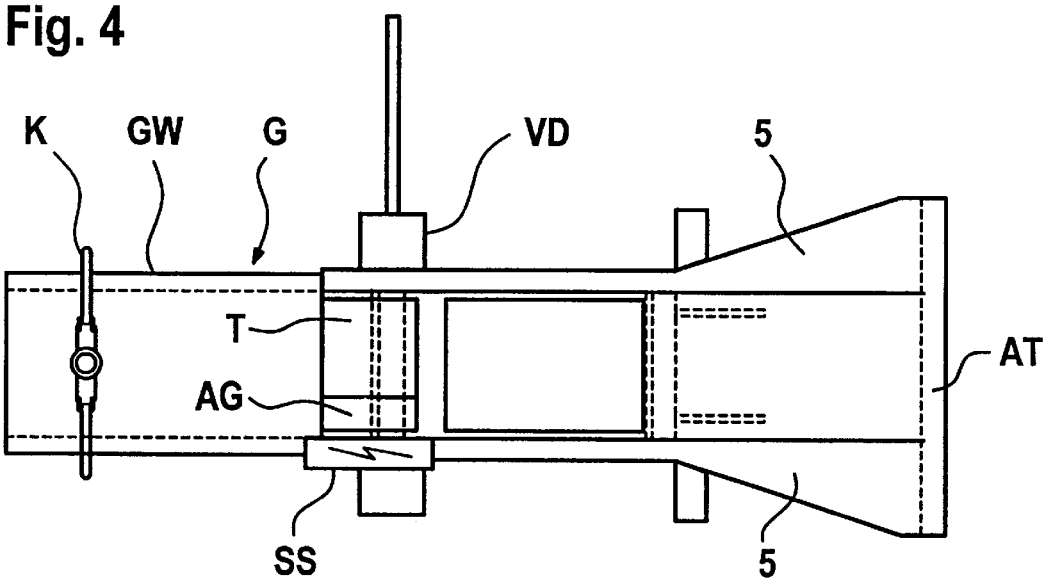
FIG. 4 is a top view of the bale press of FIG. 1.
Figure 1A:
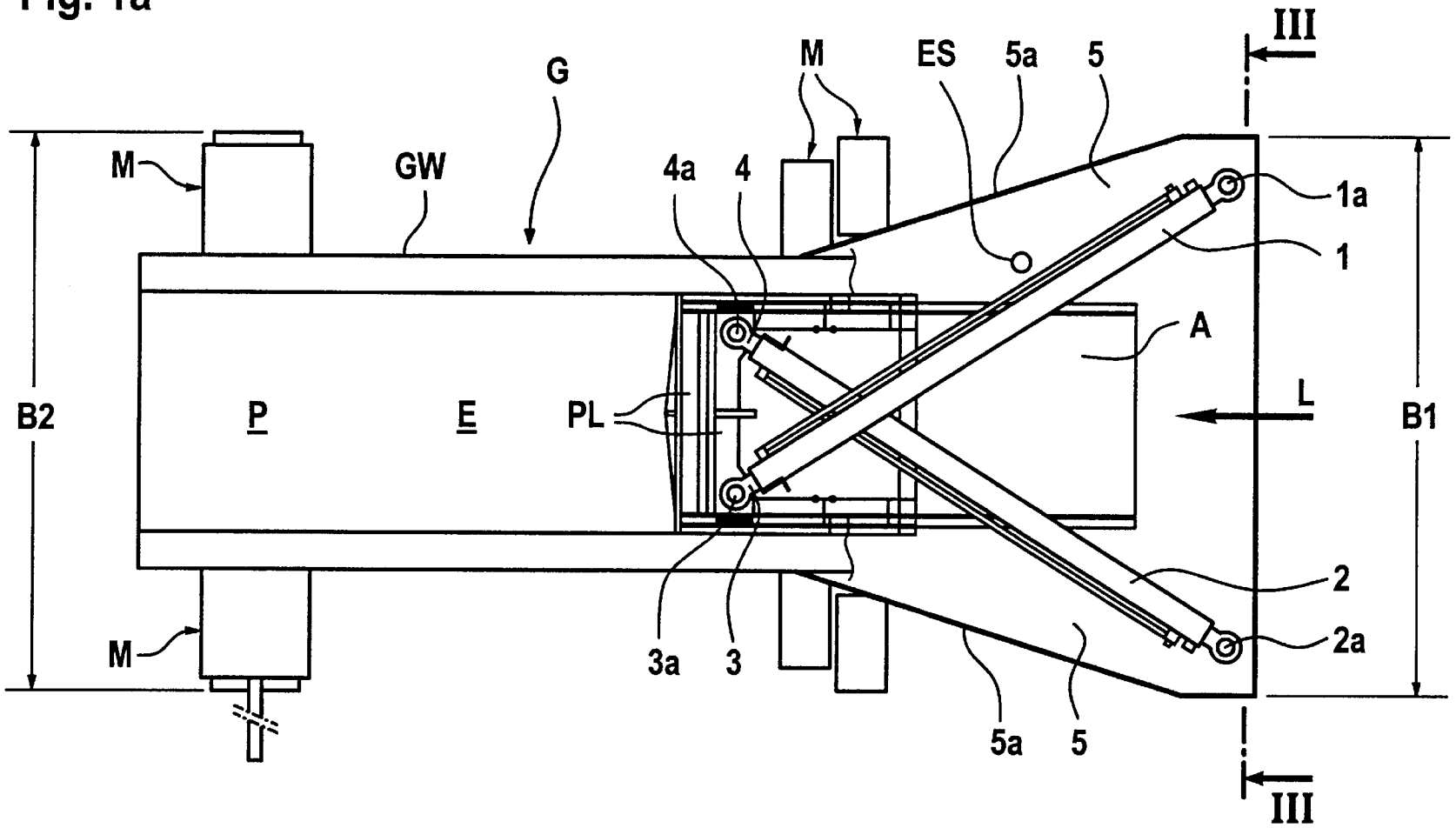
FIG. 1*a* is a top view, on a slightly larger scale, of the drive system in the basic position thereof, with the upper cover being removed.

The general configuration of the waste bale press according to the present invention is shown in FIGS. 1 and 4. FIG. 1*a* shows the drive arrangement according to the present invention in which the points of connection 1*a* and 2*a* of the hydraulic cylinders 1 and 2 are located on brackets 5 or the like laterally of the press housing G outside of the parallel limiting walls GW of the press housing G in the rearmost part of the drive portion A.

Accordingly, compared to the prior art discussed above, in this novel cylinder arrangement according to the present invention only a very small loss component of the drive energy occurs already at the beginning of a pressing stroke; this has a very positive effect especially when introducing pressing strokes when the filling shaft E underneath the hopper EW is already full of material and the bale has already been more or less precompacted by previous pressing strokes.

Figure 2:
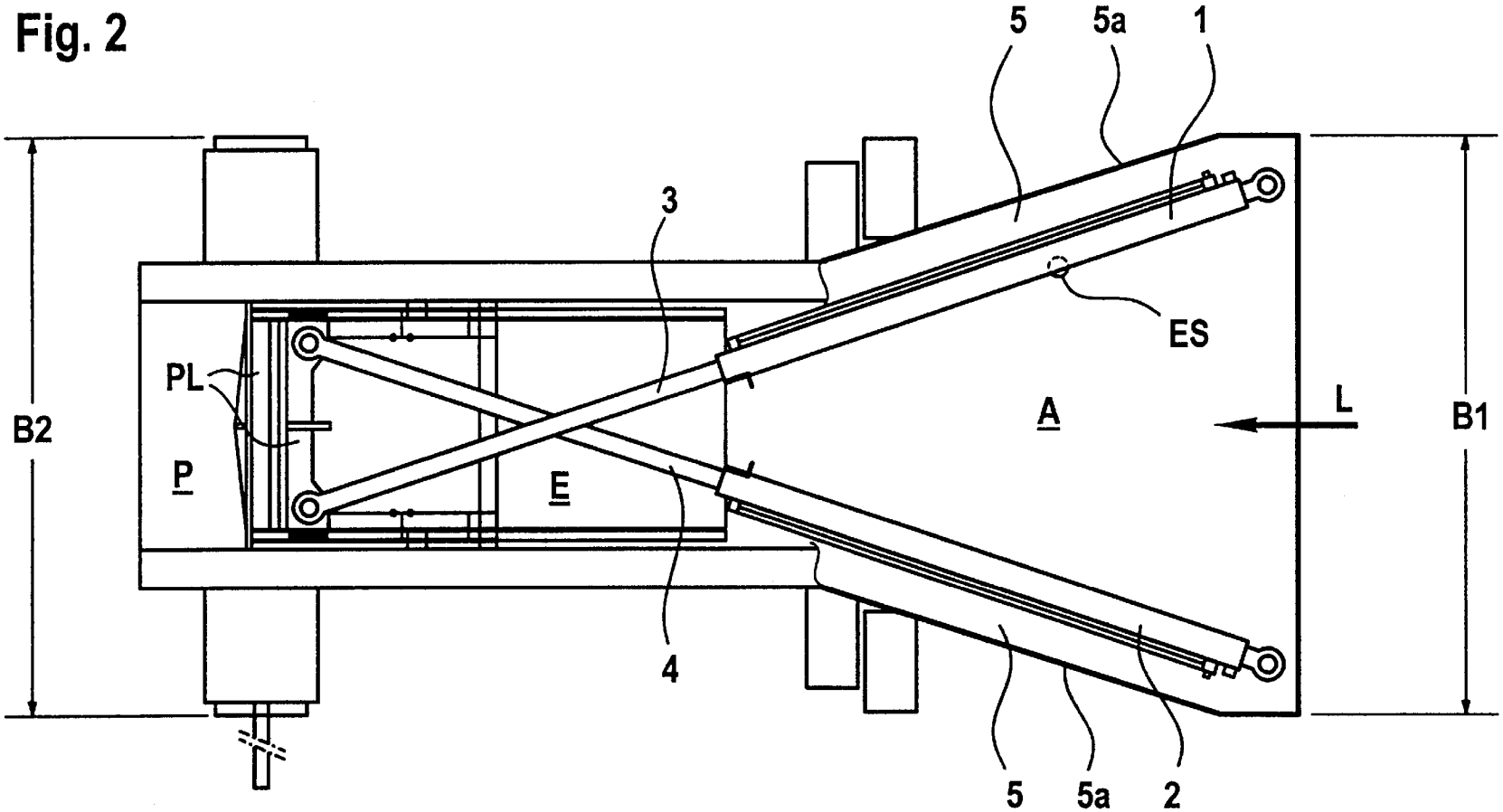
FIG. 2 is a view similar to FIG. 1*a,* shown in the end position with fully extended piston rods.
Figure 3:
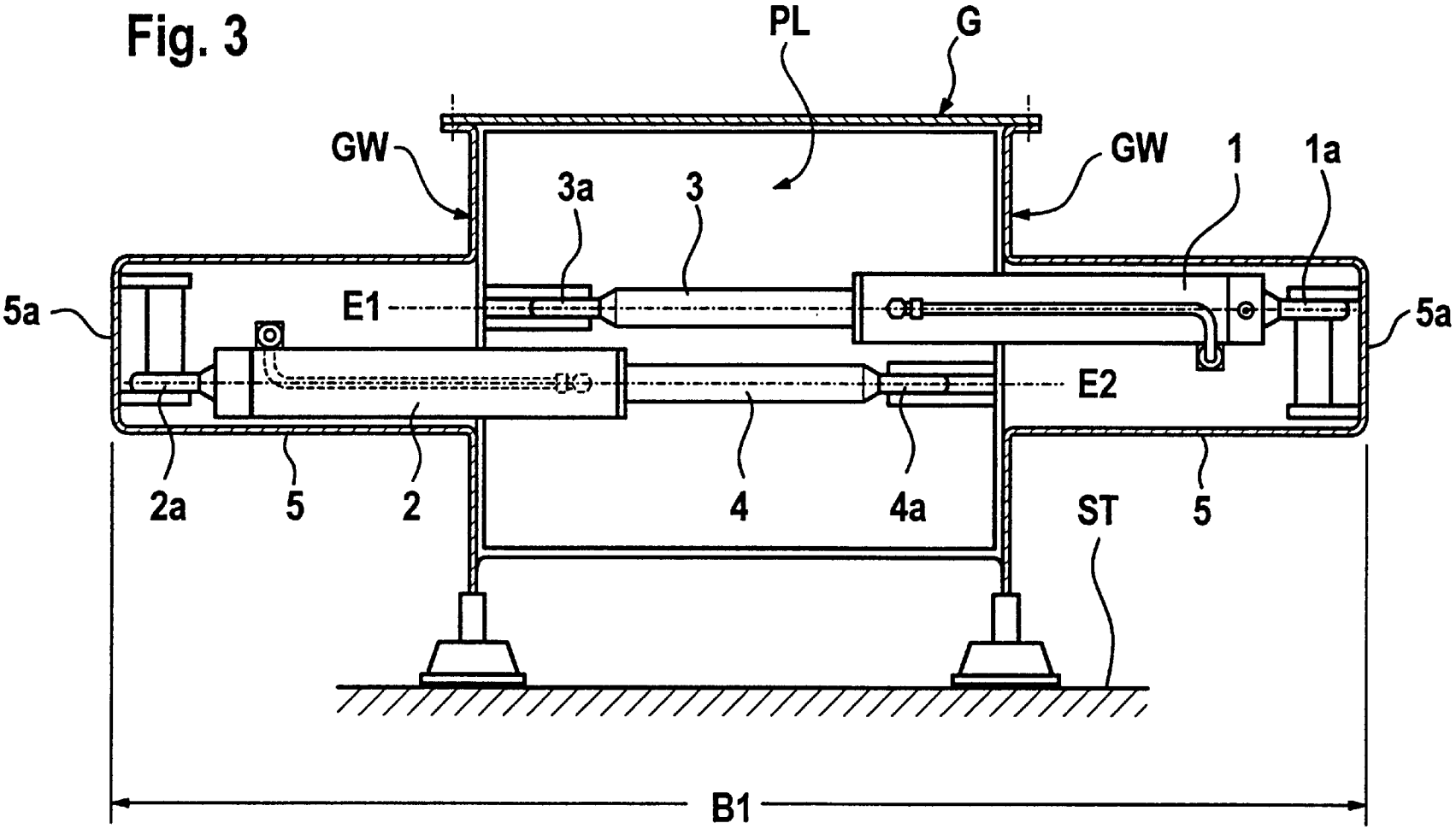
FIG. 3 is a cross-sectional view through the drive portion along sectional line III—III.

In accordance with a special structural feature of the present invention, the brackets 5 are constructed as outwardly closed box-like projections or bulges 5, 5*a* of the drive portion A of the press housing G, wherein it is additionally important that, seen in the longitudinal direction L, the total width $B_1$ of the projections 5 is not greater than the width $B_2$ of the press housing G including any machine units M mounted on the press housing G. Finally, it is important in connection with the distribution of the forces and torques at the press plate that the hydraulic cylinders 1 and 2 including the corresponding piston rods 3 and 4 and the connecting points 1*a*, 2*a* and 3*a*, 4*a* at the brackets 5, 5*a*, and on the press plate PL are located in two parallel planes $E_1$, and $E_2$, and, when the piston rods are fully extended as shown in FIG. 2, the cylinders 1 and 2 extend approximately parallel to the lateral outlines 5a of the housing projections 5.

Since the hydraulic cylinders 1 and 2 carry out a pivoting movement when the piston rods 3 and 4 are moved in and out, it is possible to detect and control directly at the cylinder tubes the intermediate stations of the position of the press plate PL by means of limit switches ES or the like mounted on the bracket floor 5. As a result, the switching rod which was always required in previous press drives and requires a large amount of space has become superfluous.

In accordance with another structurally important feature of the present invention, not only the box-like brackets 5, 5*a* are screwed releasably to the lateral housing walls GW of the drive portion AT, but also the machine portions of the drive AT, the press box PK and the pressing duct P including conicity adjusting elements K are screwed together and, thus, can be disassembled for transport.

In accordance with another advantageous structural feature of the present invention, a twisting unit VD for the binding wires, the drive motor AG, the hydraulic tank T and the switching cabinet SS are located in a line extending transversely of the press housing G above the press box portion PK. In addition, a single electric motor is provided for the hydraulic drive unit AG and for all other required machine functions.

Accordingly, the concept of arranging the cylinders in accordance with the present invention not only reduces in an advantageous manner the structural length of the press, but is also increases the safety of operation, the ease of maintenance and the accessibility and arrangement of all structural components.

In addition, the press according to the present invention especially as shown in FIG. 1 makes it possible because of the fact that the drive cylinders 1 and 2 can be removed laterally and the brackets 5 are connected by screws, to place the press directly in front of a building wall W or underneath a ramp R on which it is possible to walk onto the ground ST.

While specific embodiments of the invention have been shown and described in detail to illustrate the inventive principles, it will be understood that the invention may be embodied otherwise without departing from such principles.

I claim:

1. A press for manufacturing bound bales of predominantly organic waste materials, the press comprising a press housing having parallel limiting walls, a press shaft, a press plate mounted in the press shaft, a filling shaft mounted in front of the press shaft, and a drive portion arranged in front of the filling shaft, the drive portion comprising two hydraulic cylinders mounted so as to intersect in a basic position thereof, the hydraulic cylinders having free piston rod ends connected to the press plate and cylinder ends, further comprising brackets located in a part of the drive portion located farthest away from the press plate, wherein the brackets are mounted laterally of the press housing outside of the parallel limiting walls thereof, and wherein the cylinder ends are connected to the brackets in points of connection.

2. The bale press according to claim 1, wherein the brackets are box-shaped outwardly closed projections of the drive portion of the press housing.

3. The bale press according to claim 2, wherein the box-shaped brackets are releasably screwed to the lateral housing walls of the drive portion.

4. The bale press according to claim 1, wherein the hydraulic cylinders and the free piston rod ends and the points of connection of the cylinders to the brackets are located in two planes extending parallel to each other.

5. The bale press according to claim 1, wherein the brackets have lateral limitations, and wherein the piston rods of the cylinders when fully extended extend approximately parallel to the lateral limitations.

6. The bale press according to claim 1, wherein the bale press has a longitudinal direction, and wherein projected in the longitudinal direction a total width of the brackets does not exceed a width of the press housing including any machine units mounted on the press housing and required for operating the bale press.

7. The bale press according to claim 1, wherein at least a machine part of the drive portion, the filling shaft, the press shaft including elements for adjusting a conicity of the press shaft are connected to each other by screws so as to be capable of disassembly for transport.

8. The bale press according to claim 1, further comprising at least one limit switch in a range of movement of the hydraulic cylinders and configured to cooperate with the hydraulic cylinders to detect and control directly the position of the press plate.

9. The bale press according to claim 1, wherein a twisting device for binding wires for binding the bales, a hydraulic drive unit configured to drive the hydraulic cylinders, a hydraulic tank connected to the hydraulic drive unit, and a switching cabinet for electric connections are arranged in a line extending transversely of the press housing above a press box portion of the filling shaft.

10. The bale press according to claim 1, comprising a single electric motor configured to drive the bale press.

* * * * *